US008573584B2

(12) United States Patent
Idehara et al.

(10) Patent No.: US 8,573,584 B2
(45) Date of Patent: Nov. 5, 2013

(54) IMAGE FORMING APPARATUS

(71) Applicants: Ryoh Idehara, Kanagawa (JP); Satoshi Kunioka, Hyogo (JP)

(72) Inventors: Ryoh Idehara, Kanagawa (JP); Satoshi Kunioka, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/686,202

(22) Filed: Nov. 27, 2012

(65) Prior Publication Data

US 2013/0134660 A1 May 30, 2013

(30) Foreign Application Priority Data

Nov. 30, 2011 (JP) ..... 2011-262785

(51) Int. Cl.
*B65H 1/00* (2006.01)

(52) U.S. Cl.
USPC ..... 271/3.14; 271/164; 271/162; 271/213; 271/145

(58) Field of Classification Search
USPC ..... 271/3.14, 162, 164, 213, 145
See application file for complete search history.

(56) References Cited

U.S. PATENT DOCUMENTS 4,083,553 A * 4/1978 Beck et al. ..... 271/4.01
8,202,015 B2 * 6/2012 Peck et al. ..... 400/693
2008/0174065 A1 7/2008 Kita et al.
2009/0041525 A1 2/2009 Kunioka
2011/0109037 A1 5/2011 Kunioka
2011/0298171 A1 12/2011 Kita et al.
2012/0119430 A1 5/2012 Idehara

FOREIGN PATENT DOCUMENTS

JP 2010-58864 3/2010

OTHER PUBLICATIONS

U.S. Appl. No. 13/479,380, filed May 24, 2012, Satoshi Kunioka.

* cited by examiner

*Primary Examiner* — Luis A Gonzalez
(74) *Attorney, Agent, or Firm* — Cooper & Dunham LLP

(57) ABSTRACT

An image forming apparatus including a sheet container, a sheet stacking member to closably open the sheet container; a restriction unit to restrict a swinging movement of the sheet stacking member, and a stopper mechanism to restrict insertion of the sheet container into the image forming apparatus in a state in which the sheet stacking member swings open from the sheet container. The stopper mechanism includes a stopped member provided to the sheet container and being movable vertically along the swinging movement of the sheet stacking member, and a stopper member provided to the image forming apparatus and being contactable with the stopped member. The stopped member includes a stopped surface contacted by the stopper member in a state in which the stopped member is lifted; and a switching surface adjacent to the stopped surface and vertically moving the stopped member by contact against the stopper member.

7 Claims, 17 Drawing Sheets

IMAGE FORMING APPARATUS

CROSS-REFERENCE TO RELATED APPLICATION

This patent application is based on and claims priority pursuant to 35 U.S.C. §119 to Japanese Patent Application No. 2011-262785, filed on Nov. 30, 2011, in the Japan Patent Office, the entire disclosure of which is hereby incorporated by reference herein.

BACKGROUND OF THE INVENTION

1. Field of the Invention

Exemplary aspects of the present invention generally relate to an image forming apparatus such as a printer, copier, plotter, facsimile machine, or multifunction device having two or more of these capabilities.

2. Description of the Related Art

One type of image forming apparatus, such as a printer, copier, plotter, facsimile machine, or multifunction device having two or more of these capabilities, is an inkjet recording device employing a liquid ejection recording method. The inkjet recording device includes a recording head that ejects droplets of a recording liquid such as ink from nozzles in the recording head onto a sheet of recording media to form an image on the sheet. Examples of the inkjet recording device include a serial-type image forming apparatus, in which the recording head ejects ink droplets while moving in a main scanning direction to form an image on the sheet, and a line-type image forming apparatus equipped with a line-type recording head that ejects ink droplets while remaining stationary to form an image on the sheet.

The image forming apparatus generally includes a sheet feed tray attached to the image forming apparatus or a sheet feed cassette detachably attachable to the image forming apparatus, from which the sheet is fed to the image forming apparatus. It is to be noted that, in this specification, the sheet feed tray is either mounted or detachably attached to the image forming apparatus and need not be detached from the image forming apparatus upon supply of sheets to the sheet feed tray, whereas the sheet feed cassette is detachably attached to the image forming apparatus and needs to be withdrawn or detached from the image forming apparatus to resupply the sheets.

The sheet feed cassette is generally disposed near the bottom portion of the image forming apparatus. In a compact image forming apparatus, a mechanism for sheet feeding and sheet separation is often provided on the opposite side from a grip of the sheet feed cassette used for withdrawing the sheet feed cassette from the image forming apparatus upon, for example, supply of the sheets to the sheet feed cassette.

In addition, a discharge tray to which the sheet having the image formed thereon is discharged is generally disposed above and adjacent to the sheet feed cassette in order to make the image forming apparatus more compact. The discharge tray is often hinged to allow the sheet feed cassette to be opened and closed, thereby facilitating removal of jammed or misplaced sheets. However, because the above-described configuration allows supply of the sheets without detaching the sheet feed cassette from the image forming apparatus, the sheets may be improperly supplied to the sheet feed cassette.

For the purpose of properly supplying the sheets to the sheet feed cassette by opening a cover, that is, the discharge tray, from the sheet feed cassette, there is known a configuration that prevents the discharge tray from swinging open from the sheet feed cassette and thus preventing supply of the sheets to the sheet feed cassette unless the sheet feed cassette is withdrawn to a certain position from the image forming apparatus. In addition, a stopper mechanism that prevents insertion of the sheet feed cassette into the image forming apparatus when the discharge tray swings open from the sheet feed cassette may be used.

However, the stopper mechanism requires a large installation space especially in a width direction of the image forming apparatus perpendicular to a direction of withdrawal of the sheet feed cassette from the image forming apparatus, thereby preventing reduction in the size of the image forming apparatus.

SUMMARY OF THE INVENTION

In view of the foregoing, illustrative embodiments of the present invention provide a novel image forming apparatus in which recording media are properly supplied to a sheet feed cassette and an installation space for a stopper mechanism is minimized and thus making the image forming apparatus more compact.

In one illustrative embodiment, an image forming apparatus includes a sheet container at least partially withdrawable from the image forming apparatus to a sheet supply position and including a platform member on which a sheet is placed, the platform member being hinged between a sheet feed position in which the sheet placed on the platform member contacts a sheet feed unit provided to the image forming apparatus and a lower position lowered from the sheet feed position, the platform member being located at the lower position upon withdrawal of the sheet container from the image forming apparatus by a predetermined distance; a sheet stacking member on which a sheet discharged from the image forming apparatus is stacked, the sheet stacking member hinged to the image forming apparatus to closably open the sheet container; a restriction unit to restrict a swinging movement of the sheet stacking member in a state in which the platform member is located at the sheet feed and allow the swinging movement of the sheet stacking member in a state in which the platform member is located at the lower position; and a stopper mechanism to restrict insertion of the sheet container into the image forming apparatus in a state in which the sheet stacking member swings open from the sheet container. The stopper mechanism includes a stopped member provided to the sheet container, the stopped member being movable vertically along the swinging movement of the sheet stacking member and being lifted from the sheet container toward the sheet stacking member in the state in which the sheet stacking member swings open from the sheet container; and a stopper member provided to the image forming apparatus, the stopper member being contactable with the stopped member at a portion inside the sheet container in a width direction perpendicular to a direction of withdrawal of the sheet container. The stopped member includes a stopped surface contacted by the stopper member in a state in which the stopped member is lifted; and a switching surface adjacent to the stopped surface, the switching surface vertically moving the stopped member by contact against the stopper member.

Additional features and advantages of the present disclosure will become more fully apparent from the following detailed description of illustrative embodiments, the accompanying drawings, and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF THE INVENTION

Figure 1:
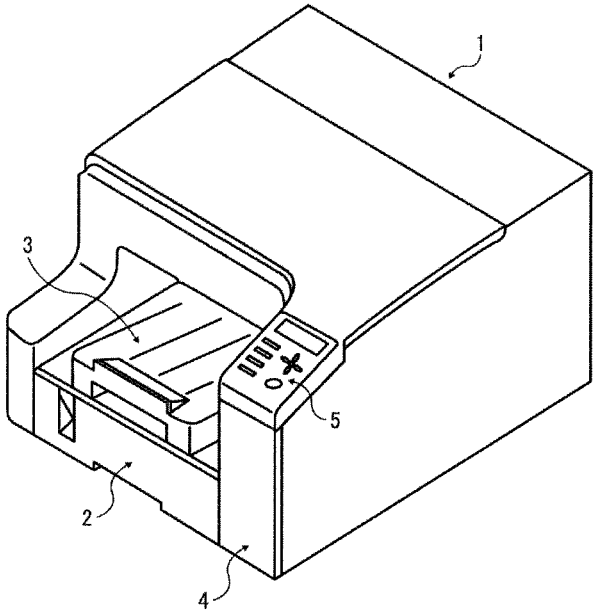
FIG. 1 is a perspective view illustrating the external appearance of an example of an image forming apparatus according to a first illustrative embodiment.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings. In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

Image forming apparatuses hereinafter described form an image on a recording medium, such as paper, string, fiber, cloth, lather, metal, plastics, glass, wood, and ceramics by ejecting ink droplets onto the recording medium. In this specification, an "image" refers to both signifying images, such as characters and figures, as well as a non-signifying image such as patterns, and moreover is not limited to a flat image, but also includes an image formed on a three-dimensional object, a three-dimensional image, and so forth.

An image forming apparatus 1 according to illustrative embodiments described in detail below is an inkjet-type image forming apparatus employing a liquid ejection recording method. The inkjet-type image forming apparatus employing the liquid ejection recording method includes a recording head that ejects liquid droplets such as ink droplets onto a sheet of recording media to form an image on the sheet. As described previously, examples of the inkjet-type image forming apparatus include a serial-type image forming apparatus, in which the recording head ejects ink droplets while moving in a main scanning direction to form an image on the sheet, and a line-type image forming apparatus equipped with a line-type recording head that ejects ink droplets while remaining stationary to form an image on the sheet.

A configuration and operation of an image forming apparatus 1 according to a first illustrative embodiment are described in detail below, with reference to FIG. 1. FIG. 1 is a perspective view illustrating the external appearance of an example of the image forming apparatus 1 according to the first illustrative embodiment.

The image forming apparatus 1 is a serial-type inkjet recording device and includes a sheet container, which, in the present illustrative embodiment, is a sheet feed cassette 2 withdrawably installable in the image forming apparatus 1, and a sheet stacking member, which, in the present illustrative embodiment, is a discharge tray 3 hingedly attachable to the image forming apparatus 1. The sheet feed cassette 2 is withdrawable from the image forming apparatus 1 to a predetermined position without being detached from the image forming apparatus 1 as described in detail later with reference to FIG. 5. The discharge tray 3 functions also as a cover of the sheet feed cassette 2 to open or close the sheet feed cassette 2.

Sheets to be fed to an image forming unit of the image forming apparatus 1 are accommodated in the sheet feed cassette 2. After an image is formed on the sheet by the image forming unit, the sheet having the image thereon is discharged to the discharge tray 3. The image forming apparatus 1 further includes a cartridge loading unit 4 disposed at one end of a front surface of the image forming apparatus 1. Ink cartridges 10*y*, 10*m*, 10*c*, and 10*k* (hereinafter collectively referred to as ink cartridges 10) are installed in the cartridge loading unit 4 as described in detail later with reference to FIG. 3. An operation unit 5 having operation buttons, a display, and so forth is provided to an upper surface of the cartridge loading unit 4.

Figure 2:
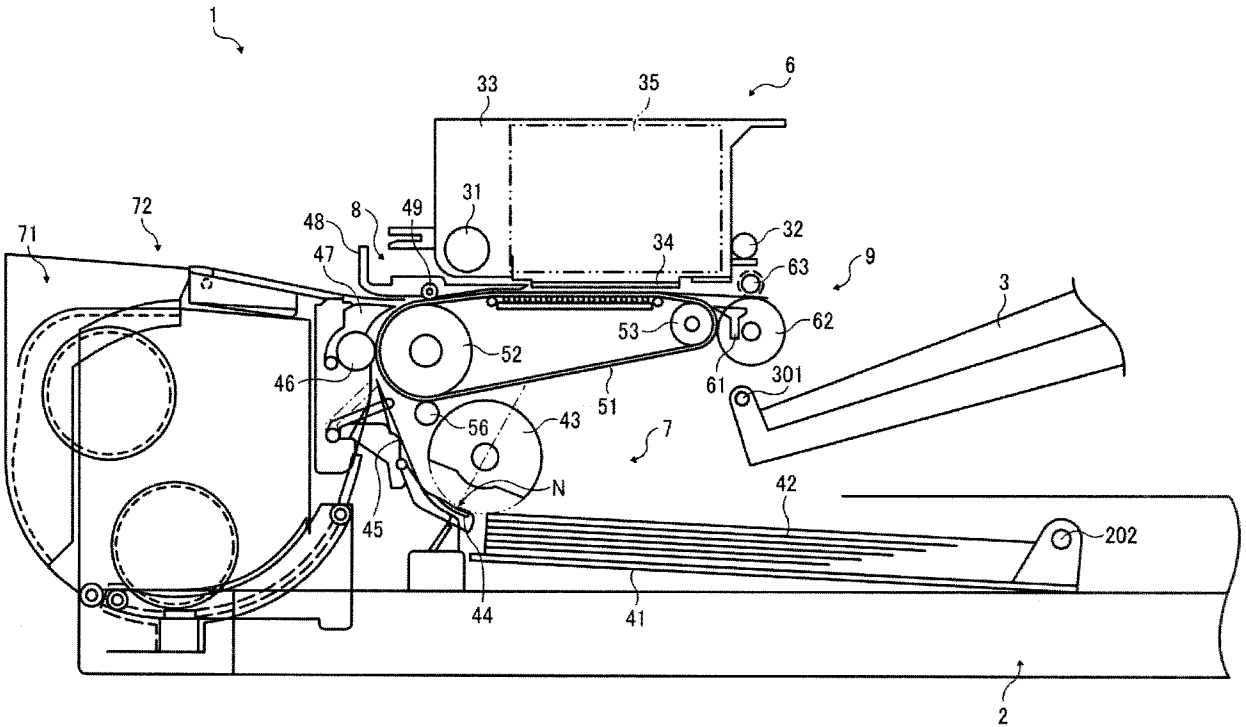
FIG. 2 is a schematic vertical cross-sectional view illustrating an example of a configuration of a mechanical portion of the image forming apparatus illustrated in FIG. 1.
Figure 3:
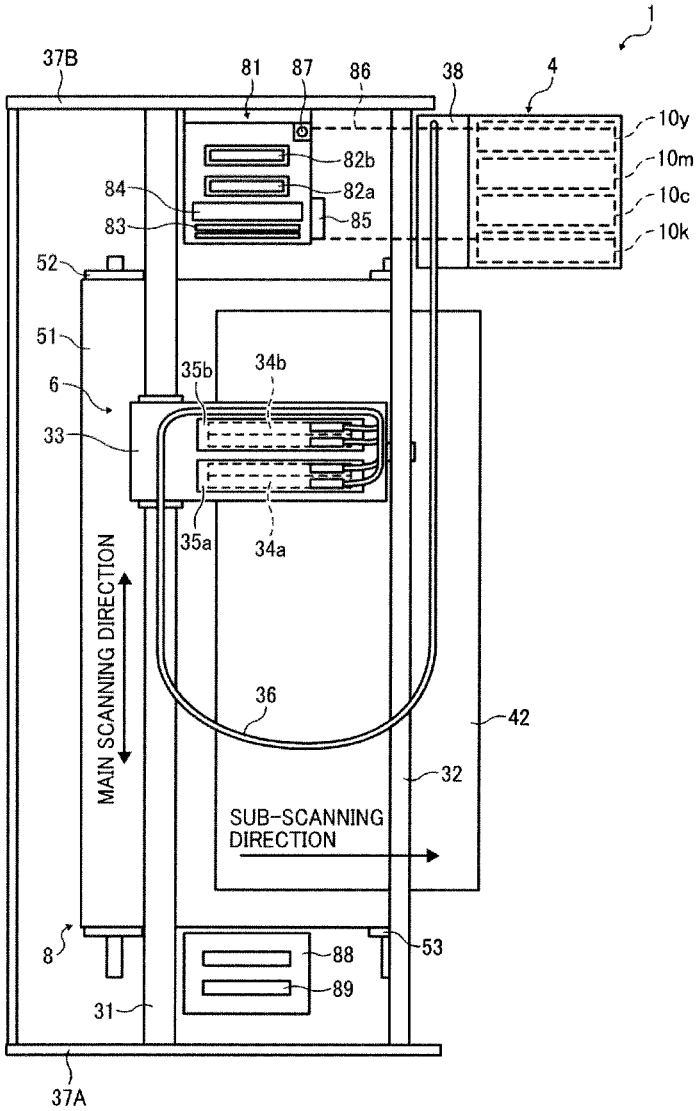
FIG. 3 is a schematic plan view illustrating the configuration of the mechanical portion of the image forming apparatus.

A configuration and operation of a mechanical portion of the image forming apparatus 1 are described below, with reference to FIGS. 2 and 3. FIG. 2 is a schematic vertical cross-sectional view illustrating an example of a configuration of the mechanical portion of the image forming apparatus 1. FIG. 3 is a schematic plan view illustrating the configuration of the mechanical portion of the image forming apparatus 1.

The mechanical portion of the image forming apparatus 1 includes an image forming part 6 including a carriage 33 and so forth, a sheet feeder 7 including the sheet feed cassette 2 and so forth, a conveyance unit 8 including a conveyance belt 51 and so forth, and a discharge unit 9 including a discharge roller 62, the discharge tray 3, and so forth.

A main guide rod 31 and a sub-guide rod 32 are extended across left and right main lateral plate 37A and 37B of the image forming apparatus 1. The carriage 33 is slidably supported by the main and sub-guide rods 31 and 32. The carriage 33 is reciprocally movable back and forth in a main scanning direction by a main scanning motor, not shown, via a timing belt to which the carriage 33 is fixed.

Recording heads 34*a* and 34*b* (hereinafter collectively referred to as recording heads 34) each constituted of a liquid ejection head that ejects ink droplets of a specific color, that is, yellow (Y), cyan (C), magenta (M), or black (K), is mounted on the carriage 33. Nozzle arrays each constituted of multiple nozzles are provided to a nozzle face of each of the recording heads 34 and arrayed in a sub-scanning direction perpendicular to the main scanning direction, such that the recording heads 34 eject ink droplets of the specified colors vertically downward.

Each of the recording heads 34*a* and 34*b* has two nozzle arrays. Black ink droplets (K) are ejected from a first nozzle array formed in the recording head 34*a*, and cyan ink droplets (C) are ejected from a second nozzle array formed therein. Similarly, magenta ink droplets (M) are ejected from a first nozzle array formed in the recording head 34*b*, and yellow ink droplets (Y) are ejected from a second nozzle array formed therein.

Sub-tanks 35*a* and 35*b* (hereinafter collectively referred to as sub-tanks 35) each supplying ink of the specified color to the recording head 34*a* or 34*b* are mounted on the carriage 33. The ink is supplied from the ink cartridges 10 detachably attachable to the cartridge loading unit 4 to the sub-tanks 35 of the recording heads 34 through supply tubes 36 by a supply pump unit 38.

The sheet feed cassette 2 includes a platform member, which, in the present illustrative embodiment, is a bottom plate 41 on which sheets 42 is placed. The bottom plate 41 is hinged between a sheet feed position in which the sheet 42 placed on the bottom plate 41 is contacted by a sheet feed roller 43 provided to the image forming apparatus 1 and a lower position to which the bottom plate 41 is lowered from the sheet feed position. It is to be noted that the bottom plate 41 of the sheet feed cassette 2 is located at the sheet feed position in FIG. 2. The sheet feed roller 43 and a separation pad 44 disposed opposite the sheet feed roller 43 separate the sheets 42 placed on the bottom plate 41 of the sheet feed cassette 2 to feed the sheets 42 one by one from the sheet feed cassette 2 to the recording heads 34. The separation pad 44 is pressed against the sheet feed roller 43 by a biasing member such as a spring, not shown, and is formed of a material having a larger frictional factor against the sheet 42 than the sheet feed roller 43. In the present illustrative embodiment, the sheet feed roller 43 and the separation pad 44 together constitute a sheet feed unit that feeds the sheet 42 placed on the bottom plate 41 of the sheet feed cassette 2.

The conveyance unit 8 conveys the sheet 42 fed from the sheet feed cassette 2 to the recording heads 34. The conveyance unit 8 includes a guide member 45 that guides the sheet 42, a counter roller 46, a conveyance guide member 47, a pressing member 48 having a pressing roller 49, and the conveyance belt 51 that electrostatically attracts the sheet 42 to convey the sheet 42 to the recording heads 34.

The conveyance belt 51 is formed of an endless belt and is wound around a conveyance roller 52 and a tension roller 53 to be rotated in the sub-scanning direction. A charging roller 56 contacts a top layer of the conveyance belt 51 and is rotated by the rotation of the conveyance belt 51 to charge the conveyance belt 51. The conveyance roller 52 is rotatively driven by a sub-scanning motor, not shown, via a timing belt to rotate the conveyance belt 51 in the sub-scanning direction, that is, a direction of conveyance of the sheet 42.

The discharge unit 9 discharges the sheet 42 having the image thereon formed by the recording heads 34 from the image forming apparatus 1. The discharge unit 9 includes a separation pick 61 that separates the sheet 42 from the conveyance belt 51, the discharge roller 62, a spur 63, and the discharge tray 3 disposed below the discharge roller 62.

A duplex unit 71 is detachably attachable to a rear surface of the image forming apparatus 1. The duplex unit 71 reverses the sheet 42 conveyed by reverse rotation of the conveyance belt 51 to convey the sheet 42 between the counter roller 46 and the conveyance belt 51 again. An upper surface of the duplex unit 71 serves as a manual sheet feed tray 72.

A maintenance/recovery mechanism 81 that maintains the nozzles in the recording heads 34 is provided outside the imaging range of the recording heads 34 at one end of the main scanning direction of the carriage 33 to prevent irregular ejection of the ink droplets from the nozzles of the recording heads 34. The maintenance/recovery mechanism 81 is constructed of cap members 82*a* and 82*b* (hereinafter collectively referred to as cap members 82), each of which covers the nozzle face of the recording head 34*a* or 34*b*, a wiper blade 83 that wipes off the nozzle face, a receiver 84 that receives ink droplets which are not used for image formation and are ejected from the nozzles to remove coagulated ink from the nozzles, and a carriage lock 87 that locks the carriage 33.

A non-replaceable first waste tank 85 that stores waste ink discharged from the ink receiver 84 is disposed below the maintenance/recovery mechanism 81. A second waste tank 86 replaceable from the front side of the image forming apparatus 1 is disposed on the lateral side of the maintenance/recovery mechanism 81 below the cartridge loading unit 4. Both the ink cartridges 10 and the second waste tank 86 are replaceable from the front side of the image forming apparatus 1 by opening a front cover of the image forming apparatus 1, thereby achieving low maintenance costs.

The image forming apparatus 1 further includes an ink receiver 88 that receives ink droplets that are not used for image formation and are ejected from the recording heads 34 to remove coagulated ink from the nozzles of the recording heads 34 during image formation. The ink receiver 88 is disposed outside the imaging range of the recording heads 34 at the other end of the main scanning direction of the carriage 33 and includes an opening 89 formed along a direction in which the nozzle arrays extend.

The sheet 42 fed from the sheet feed cassette 2 one by one is guided vertically upward by the guide member 45 and is conveyed by the conveyance belt 51 and the counter roller 46. The leading edge of the sheet 42 is further guided by the conveyance guide member 47 and is pressed against the conveyance belt 51 by the pressing roller 49 so that the direction of conveyance of the sheet 42 is changed substantially at 90°.

At this time, positive and negative voltages are applied alternately to the charging roller 56, that is, an alternating voltage is applied to the charging roller 56, from a voltage applicator, not shown, so that the conveyance belt 51 is charged in a pattern of an alternate charging voltages, that is, the conveyance belt 51 is alternately charged by positive and negative voltages with a predetermined width, in the direction of rotation of the conveyance belt 51 or the sub-scanning direction. Accordingly, the sheet 42 conveyed to the conveyance belt 51 thus alternately charged with the positive and negative voltages is electrostatically attracted to the conveyance belt 51 and is further conveyed in the sub-scanning direction by the rotation of the conveyance belt 51.

The recording heads 34 are driven based on image signals while the carriage 33 is moved so that ink droplets are ejected from the recording heads 34 onto the sheet 42, which remains stationary, so as to form a single line of an image to be formed on the sheet 42. Thereafter, the sheet 42 is conveyed by a predetermined amount to perform image formation of the next line. When receiving a completion signal or a signal which indicates that a trailing edge of the sheet 42 reaches the imaging range, the image forming apparatus 1 completes image formation and discharges the sheet 42 to the discharge tray 3.

Thereafter, the carriage 33 is moved to a home position to face the maintenance/recovery mechanism 81 during maintenance of the nozzles in the recording head 34. The nozzle faces of the recording heads 34 are capped with the cap members 82 so that coagulated ink is sucked out from the nozzles and ink droplets not used for image formation are discharged from the nozzles so as to maintain the nozzles, thereby providing stable ejection of ink droplets from the recording heads 34 and achieving higher-quality image formation.

Figure 4:
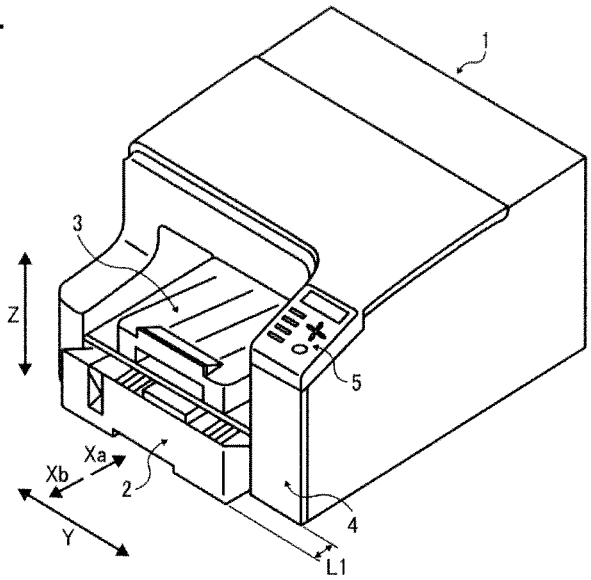
FIG. 4 is a perspective view illustrating the external appearance of the image forming apparatus from which a sheet feed cassette is withdrawn forward by a predetermined distance.
Figure 5:
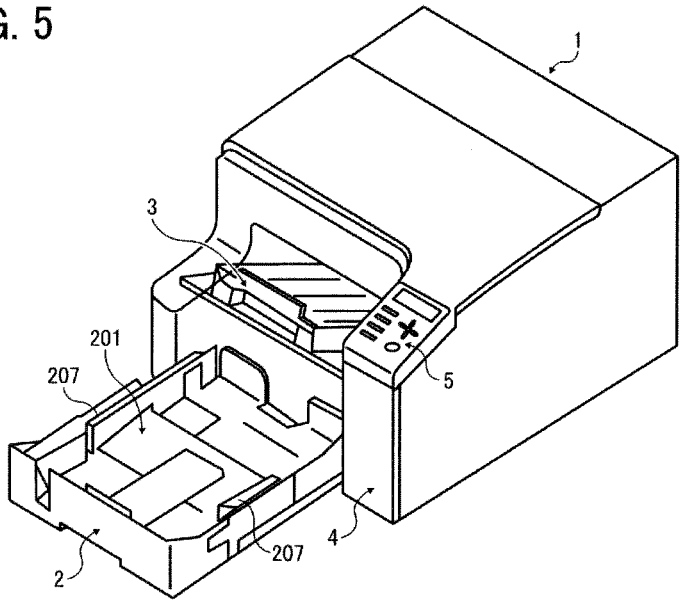
FIG. 5 is a perspective view illustrating the external appearance of the image forming apparatus in a state in which the sheet feed cassette is withdrawn to a sheet supply position.

A description is now given of feeding and discharge of the sheet 42 in the image forming apparatus 1, with reference to FIGS. 4 and 5. FIG. 4 is a perspective view illustrating the external appearance of the image forming apparatus 1 from which the sheet feed cassette 2 is withdrawn forward a predetermined distance, such that the bottom plate 41 is located at the lower position. FIG. 5 is a perspective view illustrating the external appearance of the image forming apparatus 1 in a state in which the sheet feed cassette 2 is withdrawn to a sheet supply position.

It is to be noted that the bottom plate 41, a link member, and so forth illustrated in FIGS. 6 and 7 described later are not shown in FIGS. 4 and 5 for ease of illustration. In addition, in FIG. 4 and subsequent drawings, arrow Xa indicates an insertion direction in which the sheet feed cassette 2 is inserted into the image forming apparatus 1, arrow Xb indicates a withdrawal direction in which the sheet feed cassette 2 is withdrawn from the image forming apparatus 1, arrow Y indicates a width direction of the image forming apparatus 1 perpendicular to the insertion direction Xa and the withdrawal direction Xb, and arrow Z indicate a vertical direction. The withdrawal direction Xb corresponds to a direction of discharge of the sheet 42 to the discharge tray 3, and the width direction Y corresponds the width direction of the sheet 42 and the main scanning direction.

Figure 7:
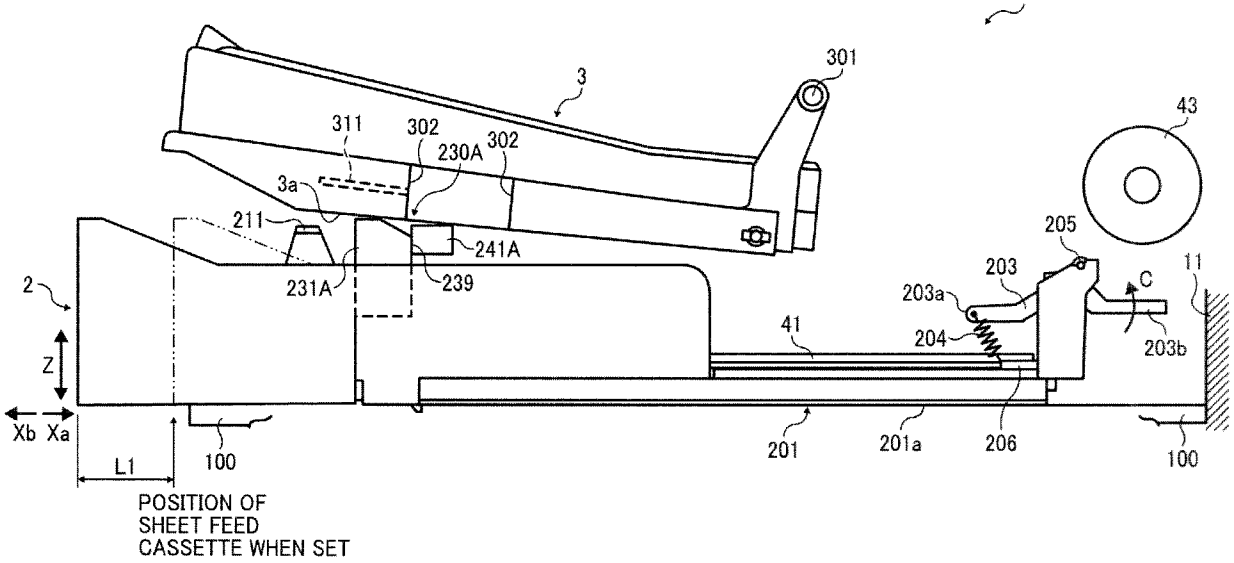
FIG. 7 is a vertical cross-sectional view illustrating an example of a configuration of the sheet feed cassette withdrawn from the image forming apparatus by a certain distance.

When the sheet feed cassette 2 is withdrawn from the image forming apparatus 1 a predetermined distance L1, the bottom plate 41 of the sheet feed cassette 2 is lowered to the lower position so that the discharge tray 3 can swing open from the sheet feed cassette 2 to an open position so as to open the sheet feed cassette 2 as illustrated in FIG. 7 described in detail later. When the discharge tray 3 swings downward to a closed position to close the sheet feed cassette 2 as illustrated in FIG. 4, the sheet feed cassette 2 can be inserted into the image forming apparatus 1.

When the sheet feed cassette 2 is completely withdrawn from the image forming apparatus 1 (but still remains attached to the image forming apparatus 1) and the discharge tray 3 swings upward to the open position to open the sheet feed cassette 2 as illustrated in FIG. 5, the sheets 42 can be supplied to the sheet feed cassette 2. It is to be noted that reference numeral 207 in FIG. 5 denotes a side fence that aligns the sheets 42 placed on the bottom plate 41 in the width direction of the sheets 42.

After supply of the sheets 42 to the sheet feed cassette 2, the discharge tray 3 swings downward to the closed position to close the sheet feed cassette 2 so that the sheet feed cassette 2 can be inserted into the image forming apparatus 1. When the discharge tray 3 swings open from the sheet feed cassette 2 as illustrated in FIG. 5, the sheet feed cassette 2 cannot be inserted into the image forming apparatus 1. In other words, the discharge tray 3 must be located at the closed position in order to set the sheet feed cassette 2 in the image forming apparatus 1.

Thus, the image forming apparatus 1 has a front-loading configuration in which the sheet feed cassette 2 is withdrawn from the image forming apparatus 1 to supply the sheets 42 to the sheet feed cassette 2 and thereafter the sheet feed cassette 2 is inserted into the image forming apparatus 1. The above-described configuration allows easy supply of the sheets 42 to the sheet feed cassette 2 from the front side of the image forming apparatus 1 and reduces installation space on both lateral sides of the image forming apparatus 1.

A description is now given of a restriction unit that restricts swinging movement of the discharge tray 3 depending on the position of the bottom plate 41 of the sheet feed cassette 2. In the present illustrative embodiment, the restriction unit is a lock mechanism 13 described in detail below with reference to FIGS. 6 and 7. FIG. 6 is a vertical cross-sectional view illustrating an example of a configuration of the sheet feed cassette 2 set in the image forming apparatus 1. FIG. 7 is vertical cross-sectional view illustrating an example of a configuration of the sheet feed cassette 2 withdrawn from the image forming apparatus 1 by a certain distance.

Figure 6:
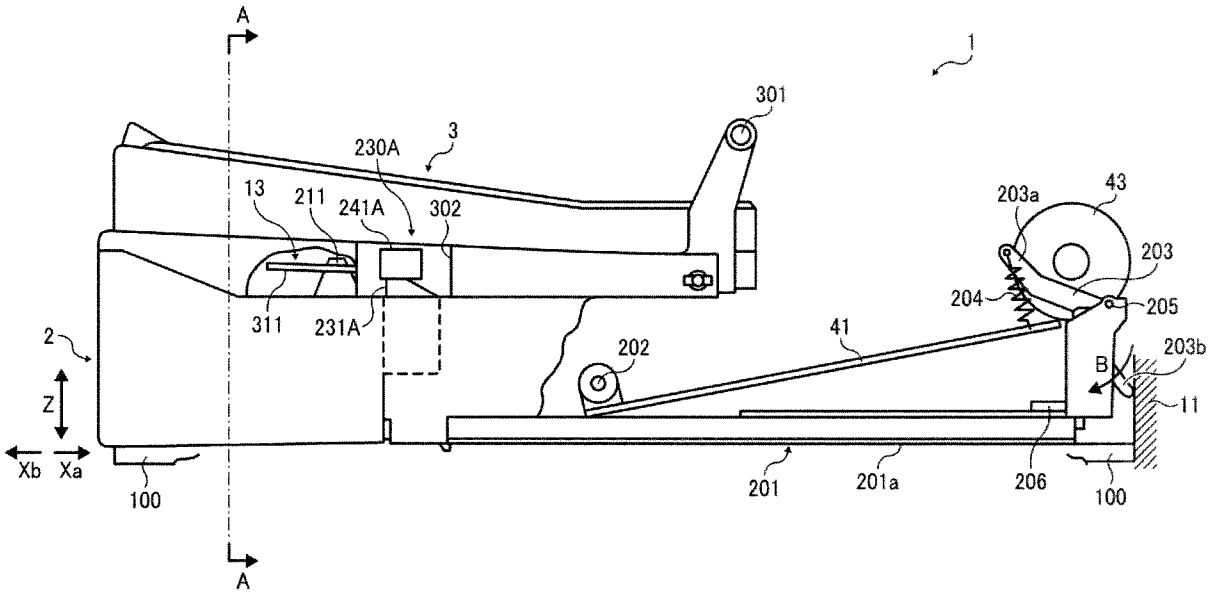
FIG. 6 is a vertical cross-sectional view illustrating an example of a configuration of the sheet feed cassette set in the image forming apparatus.

A leading edge of the bottom plate 41, that is, a right edge of the bottom plate 41 in FIG. 6, is a free edge hinged around a support shaft 202 provided inside the sheet feed cassette 2. The leading edge of the bottom plate 41 is supported by a trailing end 203*a* of a link member 203 via a spring 204. The link member 203 is hinged about a support shaft 205 provided to a main body 201 of the sheet feed cassette 2.

When the sheet feed cassette 2 is set in the image forming apparatus 1, a leading end 203*b* of the link member 203 contacts a contact portion 11 provided on an internal wall of the image forming apparatus 1 so that the link member 203 swings in a direction indicated by arrow B in FIG. 6. As a result, the trailing end 203*a* of the link member 203 is lifted such that the leading edge of the bottom plate 41 is lifted by a biasing force of the spring 204 to contact the sheet feed roller 43. It is to be noted that no sheet is placed on the bottom plate 41 in FIG. 6.

As illustrated in FIG. 7, when the sheet feed cassette 2 is withdrawn from the image forming apparatus 1 the predetermined distance L1 or greater in the withdrawal direction Xb, the leading end 203*b* of the link member 203 is separated from the contact portion 11 of the image forming apparatus 1 and is rotated in a direction indicated by arrow C by both the biasing force of the spring 204 and the weight of the bottom plate 41 and the sheets 42, not shown in FIG. 7, placed on the bottom plate 41. Accordingly, the trailing end 203*a* of the link member 203 is lowered, thus lowering the bottom plate 41 to the lower position.

The bottom plate 41 located at the lower position contacts a protrusion 206 provided to a front bottom end of the main body 201 of the sheet feed cassette 2. Thus, a user can hear a noise when the bottom plate 41 is lowered to contact the protrusion 206 and confirm that the bottom plate 41 is located at the lower position.

As described previously, the discharge tray 3 also functions as a cover that covers the sheet feed cassette 2. The discharge tray 3 is hinged about a support shaft 301 provided to the image forming apparatus 1 to open and close the sheet feed cassette 2.

The sheet feed cassette 2 is slidable against a base portion 100 fixed to the bottom of the image forming apparatus 1 in both the insertion direction Xa and the withdrawal direction Xb by the weight of the sheet feed cassette 2 itself. A well-known inexpensive configuration is used for positioning the sheet feed cassette 2 in the vertical direction Z.

The lock mechanism 13 that locks the discharge tray 3 is provided to both the sheet feed cassette 2 and the discharge tray 3. The lock mechanism 13 is constructed of a locked member, which, in the present illustrative embodiment, is a tray lock member 311 provided to the discharge tray 3, and a locking member, which, in the present illustrative embodiment, is a cassette hook member 211 provided to the sheet feed cassette 2 to engage the tray lock member 311. The lock mechanism 13 is provided on both lateral sides of the sheet feed cassette 2 in the width direction Y.

The tray lock member 311 may be formed together with the discharge tray 3 as a single integrated unit or may be provided individually from the discharge tray 3 as a separate member. The cassette hook member 211 may be formed together with the sheet feed cassette 2 as a single integrated unit or may be provided individually from the sheet feed cassette 2 as a separate member.

Compared to a related-art lock mechanism, the lock mechanism 13 according to the present illustrative embodiment is disposed inside the sheet feed cassette 2 in the width direction Y and has a slightly different shape. As illustrated in FIG. 7, the tray lock member 311 is extended substantially in the horizontal direction to engage the cassette hook member 211 in the substantially horizontal direction. Here, the term "substantially horizontal direction" refers to both the horizontal direction and a direction within design tolerance relative to the horizontal direction.

When the sheet feed cassette 2 is set in the image forming apparatus 1 or is withdrawn from the image forming apparatus 1 by an amount less than the distance L1, the cassette hook member 211 engages the tray lock member 311 as illustrated in FIG. 6. The cassette hook member 211 is disengaged from the tray lock member 311 when the sheet feed cassette 2 is withdrawn from the image forming apparatus 1 by the distance L1 or greater as illustrated in FIG. 7.

Therefore, when the bottom plate 41 of the sheet feed cassette 2 is located at the lower position as illustrated in FIG. 7, the discharge tray 3 is swung from the sheet feed cassette 2 to the open position to open the sheet feed cassette 2. By contrast, when the bottom plate 41 is lifted from the lower position to the sheet feed position as illustrated in FIG. 6, swinging movement of the discharge tray 3 is restricted. In other words, even when the sheet feed cassette 2 is slightly withdrawn from the image forming apparatus 1, the discharge tray 3 is not swung until the sheet feed cassette 2 is withdrawn from the image forming apparatus 1 by the distance L1 or greater and the bottom plate 41 is lowered to the lower position.

In the related-art image forming apparatus described previously in the background section of the specification, the discharge tray is swung upward from the sheet feed cassette even when the sheet feed cassette is not withdrawn from the image forming apparatus by the predetermined distance. Consequently, the user may supply the sheets to the sheet feed cassette from a slight gap formed between the sheet feed cassette and the discharge tray by slightly withdrawing the sheet feed cassette from the image forming apparatus. As a result, because the bottom plate of the sheet feed cassette is not located at the lower position in such a state, the sheets may be inserted beyond a nip portion between the sheet feed roller and the separation pad, thereby possibly causing multiple feeding of the sheets.

By contrast, in the image forming apparatus 100 according to the present illustrative embodiment, the lock mechanism 13 is provided such that the discharge tray 3 is not swung unless the sheet feed cassette 2 is withdrawn from the image forming apparatus 1 by the distance L1 to lower the bottom plate 41 of the sheet feed cassette 2 to the lower position. In other words, the discharge tray 3 is not swung in a state in which the sheet feed cassette 2 is set in the image forming apparatus 1 so that the sheets 42 cannot be supplied to the sheet feed cassette 2 from the slight gap between the sheet feed cassette 2 and the discharge tray 3, thereby preventing insertion of the sheets 42 beyond a nip portion N between the sheet feed roller 43 and the separation pad 44 and thus preventing multiple feeding of the sheets 42.

Thus, the image forming apparatus 1 includes the restriction unit such that the discharge tray 3 is swung only when the bottom plate 41 of the sheet feed cassette 2 is located at the lower position, and is not swung when the bottom plate 41 is located at the sheet feed position above the lower position. In a case in which the sheets 42 are supplied to the sheet feed cassette 2 without detaching the sheet feed cassette 2 from the image forming apparatus 1, the discharge tray 3 is not swung unless the bottom plate 41 of the sheet feed cassette 2 is located at the lower position, thereby achieving proper supply of the sheets 42 to the sheet feed cassette 2 and proper feeding of the sheets 42 from the sheet feed cassette 2.

Figure 9A:
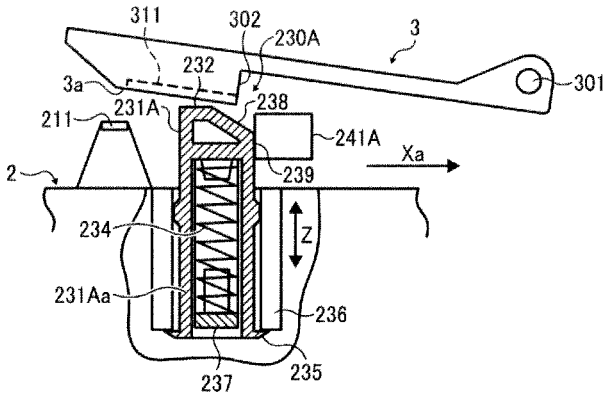
FIGS. 9A, 9B, and 9C are partial vertical cross-sectional views respectively illustrating transitional states of the stopper mechanism and a lock mechanism during insertion of the sheet feed cassette into the image forming apparatus according to the first illustrative embodiment.
Figure 9B:
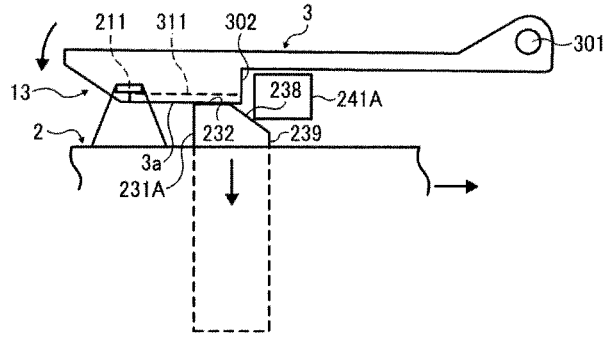
Figure 9C:
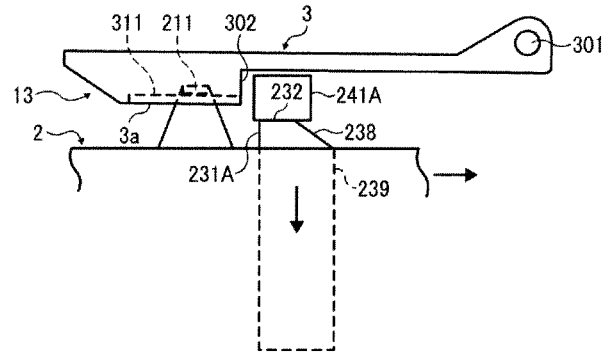
Figure 10:
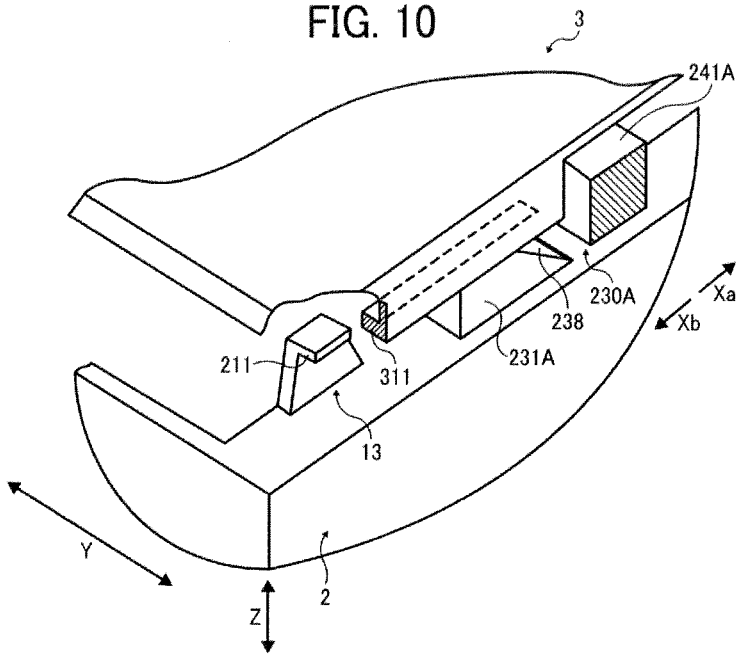
FIG. 10 is a partial perspective view illustrating the stopper mechanism and the lock mechanism when the sheet feed cassette is withdrawn from the image forming apparatus according to the first illustrative embodiment.

A description is now given of a stopper mechanism that restricts insertion of the sheet feed cassette 2 into the image forming apparatus 1 while the discharge tray 3 swings open from the sheet feed cassette 2, with reference to FIGS. 8 to 10.

Figure 8A:
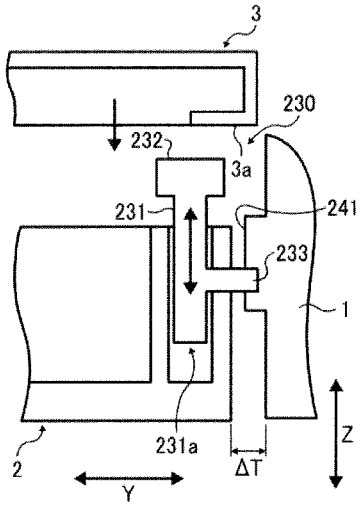
FIG. 8A RELATED ART
FIGS. 8A and 8B are vertical cross-sectional views respectively illustrating an example of a configuration of a related-art stopper mechanism.
Figure 8B:
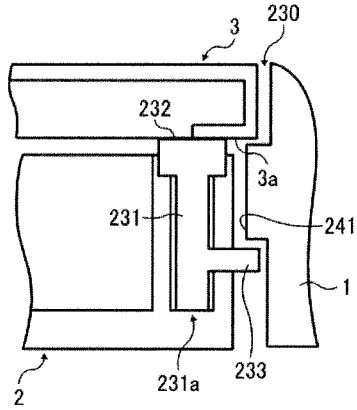
FIG. 8B RELATED ART
Figure 8C:
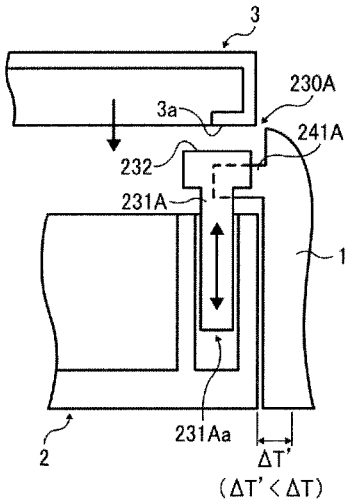
FIGS. 8C and 8D are vertical cross-sectional views along a line A-A in FIG. 6, respectively illustrating an example of a configuration of a stopper mechanism provided to the image forming apparatus according to the first illustrative embodiment.
Figure 8D:
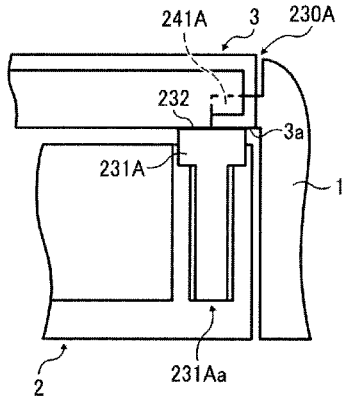

FIGS. 8A and 8B are vertical cross-sectional views respectively illustrating an example of a configuration of a related-art stopper mechanism 230. By contrast, FIGS. 8C and 8D are vertical cross-sectional views along a line A-A in FIG. 6, respectively illustrating an example of a configuration of a stopper mechanism 230A provided to the image forming apparatus according to the first illustrative embodiment. FIGS. 9A, 913, and 9C are partial vertical cross-sectional views respectively illustrating transitional states of the stopper mechanism 230A and the lock mechanism 13 during insertion of the sheet feed cassette 2 into the image forming apparatus 1 according to the first illustrative embodiment. FIG. 10 is a partial perspective view illustrating the stopper mechanism 230A and the lock mechanism 13 when the sheet feed cassette 2 is withdrawn from the image forming apparatus 1 according to the first illustrative embodiment.

For ease of comparison, the same reference numerals are used in both the first illustrative embodiment and the related art for those components having the same function even when they have slightly different shapes.

First, the related-art stopper mechanism 230 is described in detail with reference to FIGS. 8A and 8B.

The related-art stopper mechanism 230 is basically the same as the technique described previously in the background section of this specification, and includes a stopped member 231 movably mounted to the sheet feed cassette 2. The stopped member 231 is movable in the vertical direction and includes a main body 231*a*, a sloped portion 232 pressed by the discharge tray 3 disposed above the main body 231*a*, and a protrusion 233 formed together with the main body 231*a* to restrict insertion of the sheet feed cassette 2 into the image forming apparatus 1. The stopped member 231 is biased upward by a spring, not shown, provided within a hollow portion of the main body 231*a*, and engagement of an engagement portion, not shown, provided to a bottom end of the stopped member 231 and an engaged portion, not shown, restricts an amount of upward protrusion of the stopped member 231. The protrusion 233 of the stopped member 231 contacts a stopper member 241 fixed to the image forming apparatus 1 when the stopped member 231 is lifted to an upper position. The stopper mechanism 230 is provided on both lateral sides of the sheet feed cassette 2 in the width direction Y.

In the related-art stopper mechanism 230, when the discharge tray 3 swings open from the sheet feed cassette 2, the stopped member 231 of the sheet feed cassette 2 is lifted by a biasing force of the spring so that the protrusion 233 of the stopped member 231 mounted to the sheet feed cassette 2 contacts the stopper member 241 fixed to the image forming apparatus 1 as illustrated in FIG. 8A. As a result, the sheet feed cassette 2 cannot be inserted into the image forming apparatus 1.

By contrast, when the discharge tray 3 swings downward to the closed position, a bottom surface 3*a* of the discharge tray 3 presses the sloped portion 232 of the stopped member 231 downward so that the stopped member 231 is moved downward by the weight of the discharge tray 3 against the biasing force of the spring. As a result, the protrusion 233 of the stopped member 231 is separated from the stopper member 241 fixed to the image forming apparatus 1 as illustrated in FIG. 8B, and the sheet feed cassette 2 can be inserted into the image forming apparatus 1.

Thus, the stopper mechanism 230 of the related art restricts insertion of the sheet feed cassette 2 into the image forming apparatus 1 when the discharge tray 3 is located at the open position, thereby preventing insertion of the sheet feed cassette 2 into the image forming apparatus 1 when the discharge tray 3 is not located at the closed position.

In the related-art stopper mechanism 230, the protrusion 233 of the stopped member 231 protrudes outward from the sheet feed cassette 2 in the width direction Y. In addition, the stopper member 241 provided to the image forming apparatus 1 and opposite the protrusion 233 of the stopped member 231 protrudes toward the sheet feed cassette 2. Because recessed portions need to be formed in all the parts along a path of insertion and withdrawal of the sheet feed cassette 2 in a case in which neither the stopped member 231 nor the stopper member 241 has the protrusion, it is required to form the protrusions in both the stopped member 231 and the stopper member 241. Therefore, in consideration of the rigidity of the protrusion 233, a gap of from 5 mm to 10 mm is necessary between the image forming apparatus 1 and both left and right sides of the sheet feed cassette 2 in the width direction Y. Thus, a gap $\Delta T$ of from 5 mm to 10 mm is required between the sheet feed cassette 2 and the image forming apparatus 1 as shown in FIG. 8A, causing an increase in the width of the image forming apparatus 1 by from 10 mm to 20 mm.

Because the image forming apparatus 1 according to the first illustrative embodiment is compact and is often installed in a small space near the user, even a slight increase in the size of the image forming apparatus 1 may prevent installation of the image forming apparatus 1 in such a small space.

Thus, in the first illustrative embodiment, the stopper mechanism 230A that restricts insertion of the sheet feed cassette 2 into the image forming apparatus 1 when the discharge tray 3 swings open from the sheet feed cassette 2 to prevent improper supply of the sheets 42 to the sheet feed cassette 2 is provided to the image forming apparatus 1 without resulting in an increase in the size of the image forming apparatus 1.

In the first illustrative embodiment, the function of the protrusion 233 of the related art is provided to a different portion of the stopped member 231 as described in detail below. As a result, a gap $\Delta T'$ between the sheet feed cassette 2 and the image forming apparatus 1 can be minimized within a range between 0.5 mm and 1 mm, which is smaller than the gap $\Delta T$.

A description is now given of the stopper mechanism 230A provided to the image forming apparatus 1 according to the first illustrative embodiment, with reference to FIGS. 8C, 8D, 9A, 9B, 9C, and 10.

In place of the stopped member 231 and the stopper member 241 of the related art, the stopper mechanism 230A according to the first illustrative embodiment includes a stopped member 231A and a stopper member 241A, respectively. The stopped member 231A is disposed inside the sheet feed cassette 2 in the width direction Y and constructed of a switching surface, which, in the present illustrative embodiment, is a guide surface 238, and a stopped surface, which, in the present illustrative embodiment, is a contact surface 239 adjacent to the guide surface 238. The stopper member 241A is provided to the image forming apparatus 1 to engage the stopped member 231A inside the sheet feed cassette 2 in the width direction Y.

The stopped member 231A is movably mounted to the sheet feed cassette 2 in the vertical direction Z and is lifted from the sheet feed cassette 2 toward the discharge tray 3 when the discharge tray 3 swings open from the sheet feed cassette 2. The stopped member 231A is constructed of a main body 231Aa, the sloped portion 232 pressed by the bottom wall 3*a* of the discharge tray 3 disposed above the main body 231Aa, the contact surface 239 contacted by the stopper member 241A when the stopped member 231A is lifted to the upper position, the guide surface 238 provided adjacent to the contact surface 239 along the insertion direction Xa to move the stopped member 231A in the vertical direction by engagement with the stopper member 241A, and a hollow portion within which the spring 234 is disposed. The guide surface 238 is sloped downward from upstream to downstream in the insertion direction Xa of the sheet feed cassette 2.

In the present illustrative embodiment, the sloped portion 232, the contact surface 239, the guide surface 238, and the hollow portion together form the stopped member 231A as a single integrated unit in this case made of resin. The stopped member 231A is supported via the spring 234 by a support member 237 fixed to the sheet feed cassette 2. The stopped member 231A is biased upward by the spring 234 provided within the hollow portion of the main body 231Aa, and engagement of an engagement portion 235 provided to the bottom end of the stopped member 231A and an engaged portion 236 fixed to the sheet feed cassette 2 restricts an amount of upward protrusion of the stopped member 231A. The stopper mechanism 230A is provided to both sides of the sheet feed cassette 2 in the width direction Y.

A recessed portion 302 which prevents contact with the stopper member 241A fixed to the image forming apparatus 1 is formed in the bottom of both external walls of the discharge tray 3 in the width direction Y. The recessed portion 302 is recessed inward in the discharge tray 3 in the width direction Y.

As illustrated in FIG. 9A, in the stopper mechanism 230A of the present illustrative embodiment, the stopped member 231A of the sheet feed cassette 2 is lifted by the biasing force of the spring 234 when the discharge tray 3 swings open from the sheet feed cassette 2 so that the contact surface 239 contacts the stopper member 241A of the image forming apparatus 1 to prevent the sheet feed cassette 2 from being inserted into the image forming apparatus 1 in the insertion direction Xa.

By contrast, when the discharge tray 3 swings downward to the closed position as illustrated in FIG. 9B, the bottom wall 3*a* of the discharge tray 3 presses the sloped portion 232 of the stopped member 231A downward so that the stopped member 231A is moved downward by the weight of the discharge tray 3 against the biasing force of the spring 234. When the sheet feed cassette 2 is inserted into the image forming apparatus 1 in the insertion direction Xa under the above-described state, the stopper member 241A first contacted by the contact surface 239 is then contacted by the guide surface 238.

At this time, the sloped guide surface 238 that contacts and engages the stopper member 241A divides the force to insert the sheet feed cassette 2 in the insertion direction Xa into a component of force that moves the stopped member 231A further downward against the biasing force of the spring 234 so that the stopped member 231A is lowered to the lower position as illustrated in FIG. 9C. Accordingly, the sheet feed cassette 2 can be inserted into the image forming apparatus 1 without interference from the stopper member 241A.

At the same time, the cassette hook member 211 engages the tray lock member 311 to lock the discharge tray 3 toward the sheet feed cassette 2.

It is to be noted that operation of the stopper mechanism 230A during withdrawal of the sheet feed cassette 2 from the image forming apparatus 1 in the withdrawal direction Xb is the reverse of the above-described steps.

According to the first illustrative embodiment, installation space of the stopper mechanism 230A in the width direction Y of the image forming apparatus 1 can be minimized, and thus making the image forming apparatus 1 more compact while achieving the effects achieved by the related art.

Although being disposed on both sides of the sheet feed cassette 2 in the width direction Y in the above-described example, alternatively, the stopper mechanism 230A may be disposed only on the single side of the sheet feed cassette 2 in the width direction Y. As a result, the number of components can be further reduced and the image forming apparatus 1 can be further downsized, thereby reducing production costs.

In addition, the shape and position of the discharge tray 3 and the stopper mechanism 230A are not limited to the above-described example. Alternatively, the bottom wall 3*a* of the discharge tray 3 may be formed to contact the sloped portion 232 of the stopped member 231A when the discharge tray 3 is located at the closed position.

A description is now given of a first variation of the first illustrative embodiment. Although the first illustrative embodiment can make the image forming apparatus 1 more compact, the large engagement space is required for engagement of the tray lock member 311 and the cassette hook member 211, thereby preventing further reduction in the size of the image forming apparatus 1. The first variation of the first illustrative embodiment provides a configuration that reduces the size of the engagement space for the tray lock member 311 of the discharge tray 3 as described in detail below.

The wide engagement space is required for the tray lock member 311 of the discharge tray 3 because of the following reasons: neither the discharge tray 3 nor the sheet feed cassette 2 is fixed to the image forming apparatus 1 and has a positioning configuration, and therefore, both the discharge tray 3 and the sheet feed cassette 2 are attached to the image forming apparatus 1 with play; and provision of a slippage prevention member to the sheet feed cassette 2 and the discharge tray 3 prevents easy insertion of the sheet feed cassette 2 into the image forming apparatus 1.

In the first variation, in place of the stopper member 241A of the first illustrative embodiment, a stopper member 241B having a locking member, which, in the first variation, is a lock pawl 2412, is provided to the image forming apparatus 1. The lock pawl 2412 is movable in conjunction with insertion and withdrawal of the sheet feed cassette 2 into and from the image forming apparatus 1.

Figure 11A:
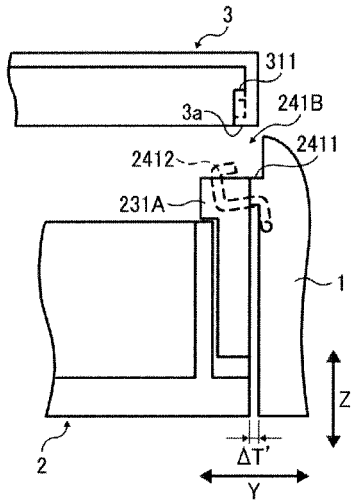
FIG. 11A is a schematic view illustrating an example of a configuration of a lock pawl provided to an image forming apparatus according to a first variation of the first illustrative embodiment in a state in which the lock pawl is disengaged from the tray lock member.
Figure 11B:
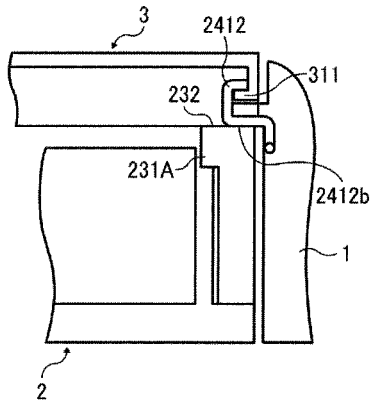
FIG. 11B is a schematic view illustrating the configuration of the lock pawl in a state in which the lock pawl engages the tray lock member.
Figure 12A:
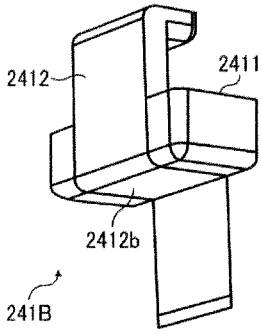
FIG. 12A is a perspective view illustrating the configuration of the lock pawl in the state in which the lock pawl engages the tray lock member.
Figure 12B:
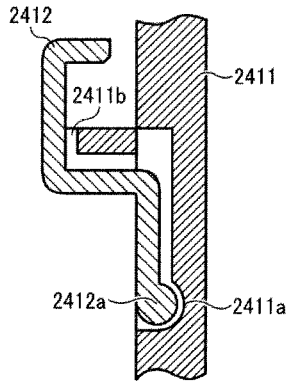
FIG. 12B is an enlarged schematic view of the lock pawl illustrated in FIG. 12B.
Figure 12C:
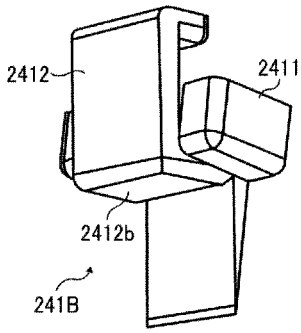
FIG. 12C is a perspective view illustrating the configuration of the lock pawl in a state in which the lock pawl is disengaged from the tray lock member.
Figure 12D:
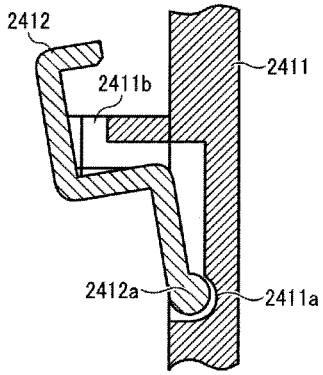
FIG. 12D is an enlarged schematic view illustrating the lock pawl illustrated in FIG. 12C.
Figure 13:
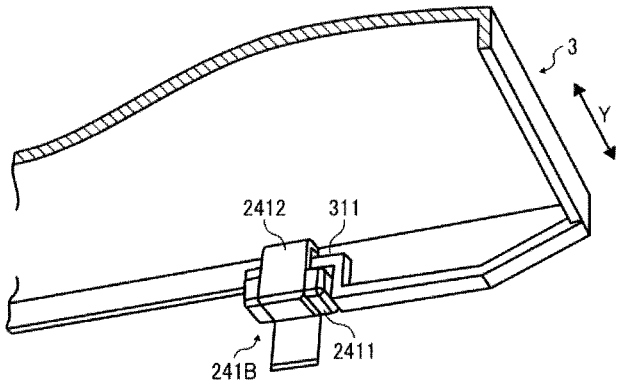
FIG. 13 is a perspective view illustrating an example of a configuration of the tray lock member provided to the image forming apparatus according to the first variation of the first illustrative embodiment.

FIG. 11A is a schematic view illustrating an example of a configuration of the lock pawl 2412 provided to the stopper member 241B according to the first variation in a state in which the lock pawl 2412 is disengaged from the tray lock member 311. FIG. 11B is a schematic view illustrating the configuration of the lock pawl 2412 in a state in which the lock pawl 2412 engages the tray lock member 311. FIG. 12A is a perspective view illustrating the configuration of the lock pawl 2412 in the state in which the lock pawl 2412 engages the tray lock member 311. FIG. 12B is an enlarged schematic view of the lock pawl 2412 illustrated in FIG. 12A. FIG. 12C is a perspective view illustrating the configuration of the lock pawl 2412 in the state in which the lock pawl 2412 is disengaged from the tray lock member 311. FIG. 12D is an enlarged schematic view of the lock pawl 2412 illustrated in FIG. 12C. FIG. 13 is a perspective view illustrating an example of a configuration of the tray lock member 311 provided to the discharge tray 3 according to the first variation of the first illustrative embodiment.

Compared to the first illustrative embodiment, in the first variation, the cassette hook member 211 of the sheet feed cassette 2 is eliminated, and the stopper member 241B is provided to the image forming apparatus 1 in place of the stopper member 241A. The rest of the configuration according to the first variation is the same as the configuration according to the first illustrative embodiment.

The stopper member 241B includes the lock member, which, in the first variation, is the lock pawl 2412 movably provided to a stopper 2411 disposed to the image forming apparatus 1. The lock pawl 2412 engages the stopped member 231A to lock the discharge tray 3.

The lock pawl 2412 has a shape folded several times substantially at 90° and includes a columnar portion 2412*a* formed together with the lock pawl 2412 at a base edge thereof. The lock pawl 2412 is supported by a bearing 2411*a* of the stopper 2411 and hinged around the columnar portion 2412*a*. A notch 2411*b* that accommodates the lock pawl 2412 when the lock pawl 2412 swings in a clockwise direction in FIGS. 12A to 12D is formed in the stopper 2411.

When being disengaged from the stopped member 231A of the sheet feed cassette 2, the lock pawl 2412 swings downward by its own weight as illustrated in FIG. 11A, 12C, or 12D. At this time, a portion of the lock pawl 2412 protrudes beyond the surface of the stopper member 231A that contacts the lock pawl 2412 upon engagement.

Operation of the lock pawl 2412 is described in detail below. When the discharge tray 3 is pressed downward to the closed position and the sheet feed cassette 2 is inserted into the image forming apparatus 1, the stopped member 231A is moved downward to prevent contact against the stopper 2411 as illustrated in FIG. 11B, 12A, or 12B. At this time, the stopped member 231A presses a bottom portion 2412*b* of the lock pawl 2412 upward against the weight of the lock pawl 2412 so that the lock pawl 2412 engages the tray lock member 311 of the discharge tray 3. Accordingly, the discharge tray 3 is locked while being closed relative to the sheet feed cassette 2 as illustrated in FIG. 13.

Thus, the large space required for engagement of the tray lock member 311 of the discharge tray 3 and the cassette hook member 211 of the sheet feed cassette 2 according to the first illustrative embodiment is not needed in the configuration according to the first variation. As a result, in addition to the effects achieved by the first illustrative embodiment, reduction in the size of the space required for engagement of the lock member and the tray lock member 311 can be achieved in the first variation, thereby making the image forming apparatus 1 more compact.

Figure 14:
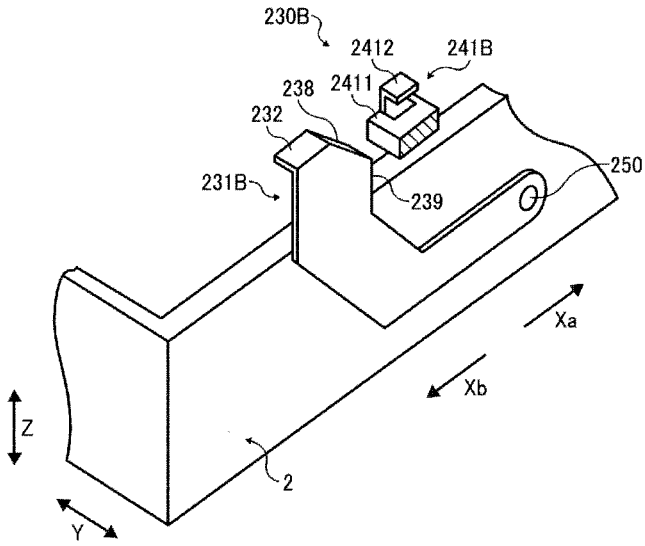
FIG. 14 is a perspective view illustrating an example of a configuration of a stopped member provided to a sheet feed cassette of an image forming apparatus according to a second variation of the first illustrative embodiment.

A description is now given of a second variation of the first illustrative embodiment with reference to FIG. 14. FIG. 14 is a perspective view illustrating an example of a configuration of a stopped member 231B provided to the sheet feed cassette 2 according to the second variation of the first illustrative embodiment.

Compared to the first variation, in place of the stopped member 231A provided movably to the sheet feed cassette 2, the stopped member 231B formed of metal is used in a stopper mechanism 230B provided to the image forming apparatus 1 according to the second variation. The rest of the configuration according to the second variation is the same as the configuration according to the first variation.

It is preferable that the stopped member 231B be formed of metal such as a thin steel plate.

A right base end of the stopped member 231B in FIG. 14 is supported by an external wall of the sheet feed cassette 2 via a support shaft 250. Accordingly, a left end of the stopped member 231B, which is a free end, is hinged in the vertical direction Z. The contact surface 239, the guide surface 238, and the sloped portion 232 are continuously formed in the free end of the stopped member 231B, and the free end of the stopped member 231E engages the stopper member 241B provided to the image forming apparatus 1 at a portion inside the sheet feed cassette 2 in the width direction Y. The free end of the stopped member 231B is biased upward by a coil spring, not shown, attached to the support shaft 250.

Although the stopped member 231B is supported by the external wall of the sheet feed cassette 2 to be movable in the vertical direction Z for ease of explanation of reduction in the gap between the stopped member 231B and the stopper member 241B in the above example, it is preferable that the stopped member 231B be disposed inside the sheet feed cassette 2 in the width direction Y to be movable in the vertical direction Z.

The stopped member 231B according to the second variation can achieve the same effects achieved by the stopped member 231A according to first illustrative embodiment and the first variation.

In addition, the space for the stopped member 231B provided to the sheet feed cassette 2 can be minimized in the second variation. Combination of the configurations according to the first and second variations can make the image forming apparatus 1 more compact while achieving the effects achieved by the prior art.

In the front-loading type image forming apparatus such as the image forming apparatus 1 according to the first illustrative embodiment, for the purpose of reducing the size of the image forming apparatus, a recording medium fed from the sheet feed cassette from the front portion to the rear portion of the image forming apparatus is generally reversed to be conveyed to the recording head. After an image is formed on the recording medium by the recording head, the recording medium having the image thereon is discharged to the discharge tray disposed above the sheet feed cassette. The discharge tray is hinged to open or close the sheet feed cassette. The technique described in the background section of this specification is also well known.

However, in the related-art image forming apparatus, in order to achieve smooth attachment of the sheet feed cassette to the image forming apparatus, the sheet feed cassette must be inserted horizontally into the image forming apparatus so as not to contact the discharge tray disposed above the sheet feed tray upon insertion of the sheet feed cassette.

In the image forming apparatus from which the sheet feed cassette is withdrawn forward to supply recording media, provision of the restriction member is required such that movement of the discharge tray is restricted when the sheet feed cassette is set in the image forming apparatus.

For example, in the image forming apparatus 1 according to the first illustrative embodiment, the restriction unit, that is, the lock mechanism 13 that locks the discharge tray 3, is provided to the sheet feed cassette 2 and the discharge tray 3. The lock mechanism 13 is constructed of the tray lock member 311 provided to the discharge tray 3 and the cassette hook member 211 provided to the sheet feed cassette 2 to engage the tray lock member 311. The tray lock member 311 is extended substantially in the horizontal direction to engage the cassette hook member 211 substantially in the horizontal direction.

When the sheet feed cassette 2 is set in the image forming apparatus 1 or is withdrawn from the image forming apparatus 1 by an amount less than the distance L1, the cassette hook member 211 engages the tray lock member 311 as illustrated in FIG. 6. The cassette hook member 211 is disengaged from the tray lock member 311 when the sheet feed cassette 2 is withdrawn from the image forming apparatus 1 by the distance L1 or greater as illustrated in FIG. 7.

In a case in which the sheet feed cassette 2 is not horizontally inserted into the image forming apparatus 1 having the lock mechanism 13, the cassette hook member 211 contacts the front surface of the discharge tray 3, thereby preventing smooth insertion of the sheet feed cassette 2 into the image forming apparatus 1. Provision of a sloped portion to a contact part in which the tray lock member 311 and the cassette hook member 211 contact each other cannot completely solve the above problem. In addition, provision of a large clearance between the cassette hook member 211 of the sheet feed cassette 2 and the front surface of the discharge tray 3 for the purpose of solving the above problem may increase the size of the image forming apparatus 1.

To solve the above problem, upon insertion of the sheet feed cassette 2 into the image forming apparatus 1, first, both the discharge tray 3 and the sheet feed cassette 2 are lifted together to combine the sheet feed cassette 2 with the discharge tray 3, and then the sheet feed cassette 2 thus combined with the discharge tray 3 is inserted into the image forming apparatus 1 according to the second illustrative embodiment as described in detail below.

Figure 15A:
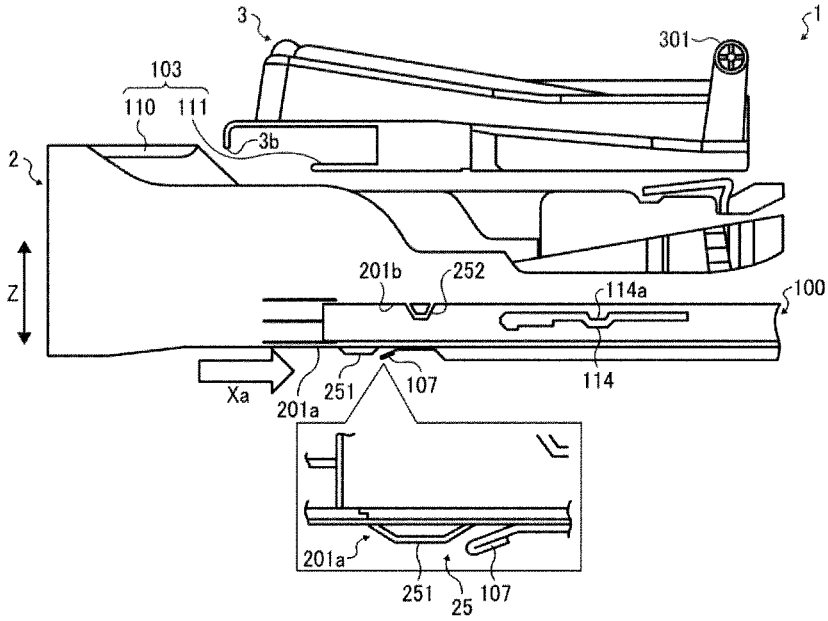
FIGS. 15A and 15B are vertical cross-sectional views respectively illustrating transitional states of an insertion mechanism provided to an image forming apparatus according to a second illustrative embodiment during insertion of the sheet feed cassette into the image forming apparatus.
Figure 15B:
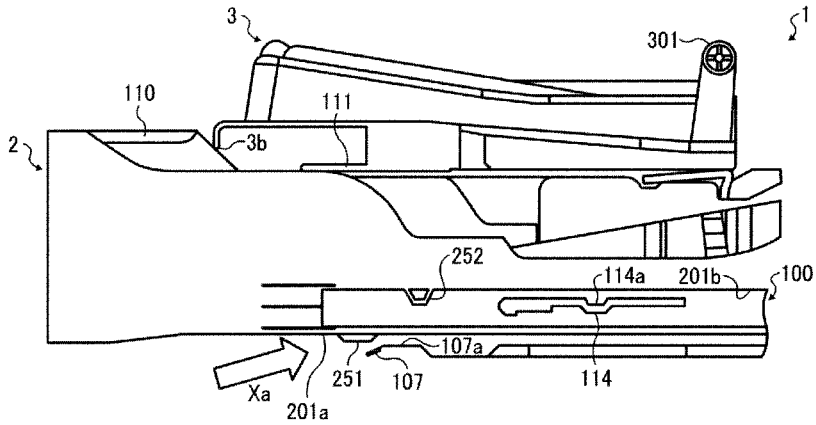
Figure 16A:
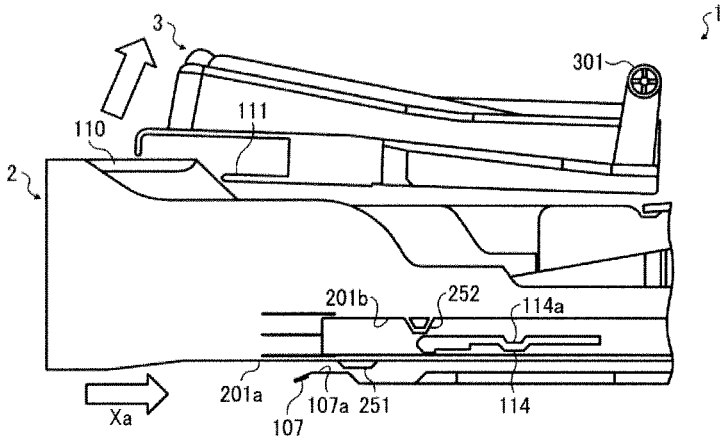
FIGS. 16A and 16B are vertical cross-sectional views respectively illustrating transitional states of the insertion mechanism after the state illustrated in FIG. 15B.
Figure 16B:
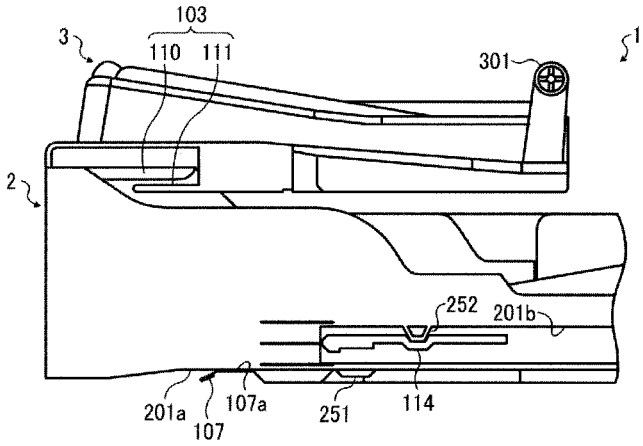
Figure 17A:
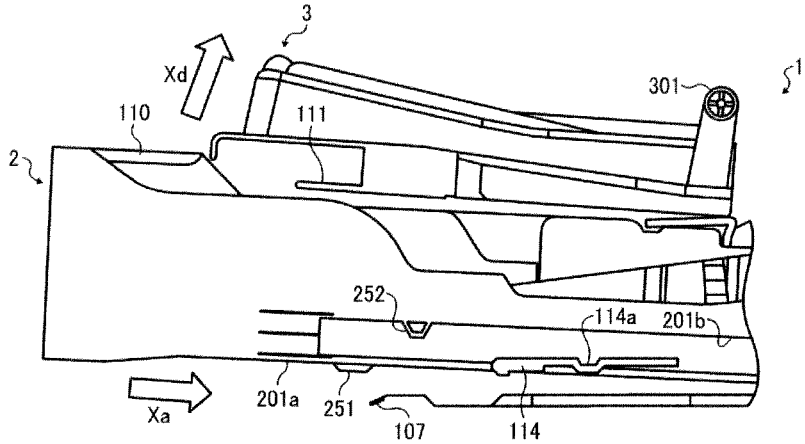
FIGS. 17A and 17B are vertical cross-sectional views respectively illustrating operation of inserting the sheet feed cassette into the image forming apparatus using the insertion mechanism.
Figure 17B:
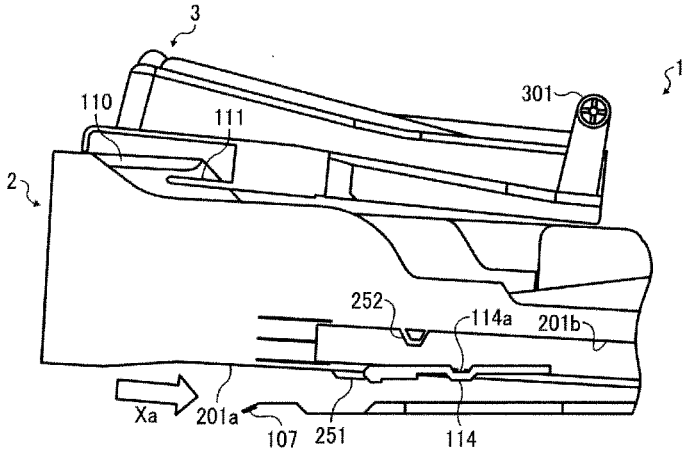

FIGS. 15A and 15B are vertical cross-sectional views respectively illustrating transitional states of an insertion mechanism 25 provided to the image forming apparatus 1 according to the second illustrative embodiment during insertion of the sheet feed cassette 2 into the image forming apparatus 1, FIGS. 16A and 16B are vertical cross-sectional views respectively illustrating transitional states of the insertion mechanism 25 after the state illustrated in FIG. 15B. FIGS. 17A and 17B are vertical cross-sectional views respectively illustrating operation of inserting the sheet feed cassette 2 into the image forming apparatus 1 using the insertion mechanism 25.

Compared to the first illustrative embodiment, in place of the lock mechanism 13, a lock mechanism 103 is used as the restriction unit in the second illustrative embodiment. Upon insertion of the sheet feed cassette 2 into the image forming apparatus 1, the sheet feed cassette 2 and the discharge tray 3 are substantially combined together in the vertical direction Z by the lock mechanism 103. In addition, the insertion mechanism 25 is used in the second illustrative embodiment such that the sheet feed cassette 2 thus combined with the discharge tray 3 is inserted into the image forming apparatus 1 while an upstream portion of the sheet feed cassette 2 in the insertion direction Xa is lifted. Further, a rail 114 having a recessed portion 114*a* is provided to the base portion 100 of the image forming apparatus 1, and a reference protrusion 252 that engages the rail 114 is provided to the bottom portion of the sheet feed cassette 2. The rest of the configuration according to the second illustrative embodiment is the same as the configuration according to the first illustrative embodiment.

The lock mechanism 103 is constructed of a locked member, which, in the present illustrative embodiment, is a lock receiver 111 provided to the discharge tray 3, and a locking member, which, in the present illustrative embodiment, is a lock member 110 provided to the sheet feed cassette 2 to engage the lock receiver 111. The lock member 110 has a sloped surface sloping downward from downstream to upstream in the insertion direction Xa of the sheet feed cassette 2.

The lock mechanism 103 is provided to both sides of the sheet feed cassette 2 in the width direction Y.

The sheet feed cassette 2 has a bottom wall 201*a* slidable against the base portion 100 of the image forming apparatus 1. A wide recessed portion 201*b* facing downward is formed at the center of the bottom wall 201*a* along the insertion direction Xa.

The insertion mechanism 25 is constructed of a sloped guide portion, which, in the present illustrative embodiment, is a base plate 107 provided to the base portion 100 of the image forming apparatus 1, and a first protrusion, which, in the present illustrative embodiment, is a protrusion 251 formed in the bottom wall 201*a* of the sheet feed cassette 2. The base plate 107 is constructed of a sloped surface sloping upward from upstream to downstream in the insertion direction Xa and a stepped portion 107*a*. The protrusion 251 protrudes downward and engages the base plate 107.

The rail 114 having the recessed portion 114*a* is provided to the base portion 100 of the image forming apparatus 1. A second protrusion, which, in the present illustrative embodiment, is the reference protrusion 252 protruding downward to engage the receiver rail 114 is provided to the recessed portion 201*b* of the sheet feed cassette 2.

Upon insertion of the sheet feed cassette 2 into the image forming apparatus 1 in the insertion direction Xa, the protrusion 251 provided to the sheet feed cassette 2 gently passes over the sloped surface of the base plate 107 provided to the base portion 100 of the image forming apparatus 1 so that the front side of the sheet feed cassette 2, that is, the left end of the sheet feed cassette 2 in FIGS. 15A and 15B, is lifted as indicated by bold arrow Xa in FIG. 15B. At this time, the lock member 110 having the sloped surface contacts a front bottom portion 3*b* of the discharge tray 3. Accordingly, the front side of the discharge tray 3 is also smoothly lifted as illustrated in FIG. 16A as the front side of the sheet feed cassette 2 is lifted. After the protrusion 251 has passed over the stepped portion 107*a* of the base plate 107 as illustrated in FIG. 16B, the lock member 110 of the sheet feed cassette 2 engages the lock receiver 111 of the discharge tray 3. Accordingly, while being located at the closed position, the discharge tray 3 is substantially combined with the sheet feed cassette 2 in the vertical direction Z, and the sheet feed cassette 2 thus combined with the discharge tray 3 is inserted into the image forming apparatus 1 in the insertion direction Xa.

As illustrated in FIG. 17A, the front side of the sheet feed cassette 2 is lifted in a direction indicated by bold arrow Xd before the reference protrusion 252, that positions the sheet feed cassette 2 upon insertion of the sheet feed cassette 2 into the image forming apparatus 1, contacts a left edge of the rail 114 in order to prevent the reference protrusion 252 from contacting the left edge of the rail 114. As a result, the sheet feed cassette 2 can be smoothly inserted into the image forming apparatus 1 and thus preventing abrasion of the reference protrusion 252 even in a case of repeated insertion of the sheet feed cassette 2 into the image forming apparatus 1.

Thus, even when the sheet feed cassette 2 is slanted relative to substantially the horizontal direction during insertion into the image forming apparatus 1, the lock member 110 and the lock receiver 111 engage each other as the sheet feed cassette 2 is slanted and thus lifting the front side of the discharge tray 3. Accordingly, the sheet feed cassette 2 can be smoothly inserted into the image forming apparatus 1 while swinging movement of the discharge tray 3 is still restricted with an uncomplicated configuration.

As described above, the insertion mechanism 25 is used in the second illustrative embodiment so that the sheet feed cassette 2 is lifted together with the discharge tray 3 to be combined with the discharge tray 3 upon insertion of the sheet feed cassette 2 into the image forming apparatus 1. As a result, the sheet feed cassette 2 can be smoothly inserted into the image forming apparatus 1 at a wide range of angle while improper supply of the sheets can be still prevented with the uncomplicated configuration.

In addition, the rail 114 having the recessed portion 114*a* is provided to the base portion 100 of the image forming apparatus 100, and the reference protrusion 252 protruding downward to engage the rail 114 is provided to the bottom wall 201*a* of the sheet feed cassette 2. The front side of the sheet feed cassette 2 is lifted in the direction indicated by the bold arrow Xd before the reference protrusion 252 contacts the left edge of the rail 114 in order to prevent the reference protrusion 252 from contacting the left edge of the receiver rail 114 upon insertion of the sheet feed cassette 2 into the image forming apparatus 1. As a result, the sheet feed cassette 2 can be further smoothly inserted into the image forming apparatus 1, and thus preventing abrasion of the reference protrusion 252 and extending the product life of the sheet feed cassette 2 even in a case of repeated insertion of the sheet feed cassette 2 into the image forming apparatus 1.

A description is now given of a stopper mechanism 230C provided to the image forming apparatus 1 according to the second illustrative embodiment, with reference to FIGS. 18A to 20B.

Figure 18A:
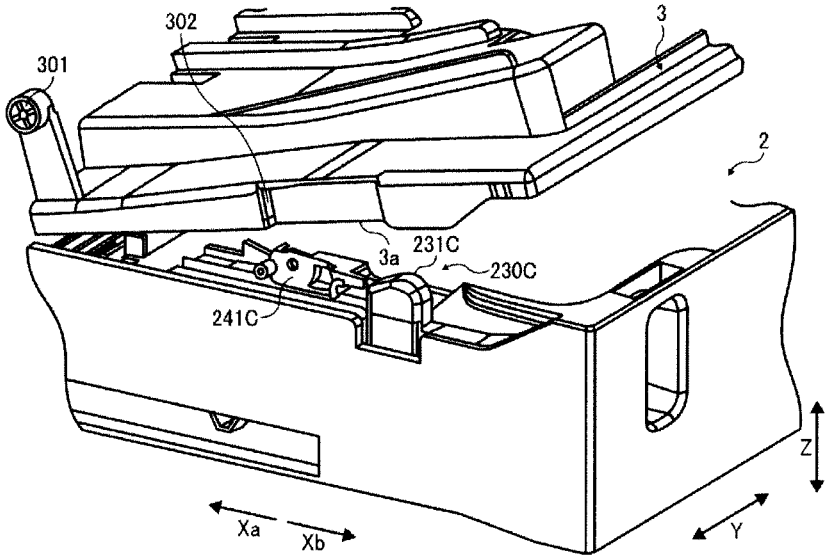
FIG. 18A is a perspective view illustrating an example of a configuration of a stopper mechanism provided to the image forming apparatus according to the second illustrative embodiment.
Figure 18B:
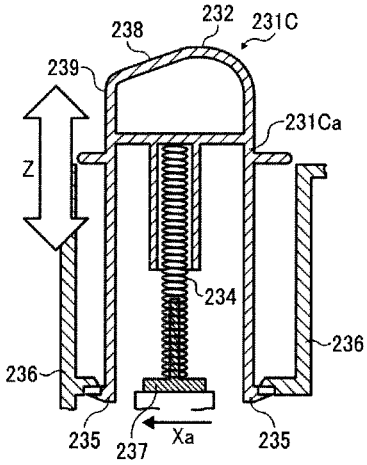
FIG. 18B is an enlarged vertical cross-sectional view illustrating an example of a stopped member included in the stopper mechanism.
Figure 19A:
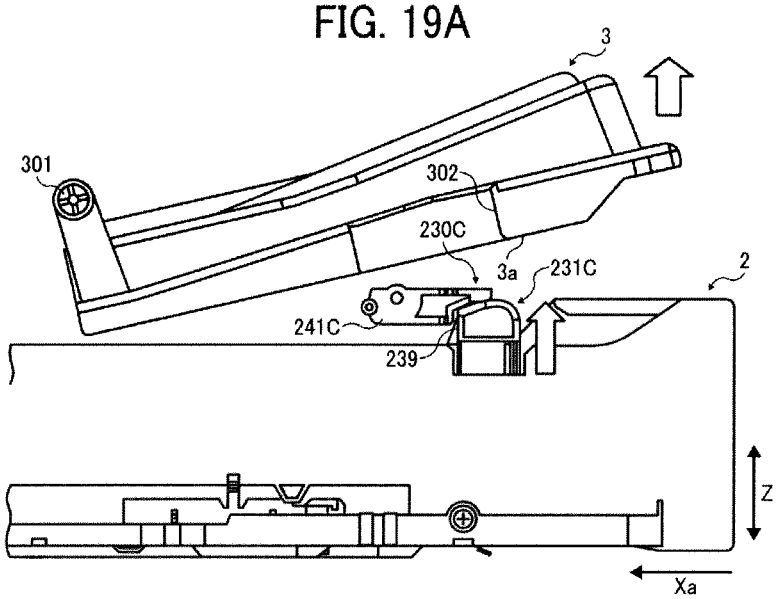
FIG. 19A is a vertical cross-sectional view illustrating operation of the stopper mechanism in a state in which the discharge tray swings open from the sheet feed cassette.
Figure 19B:
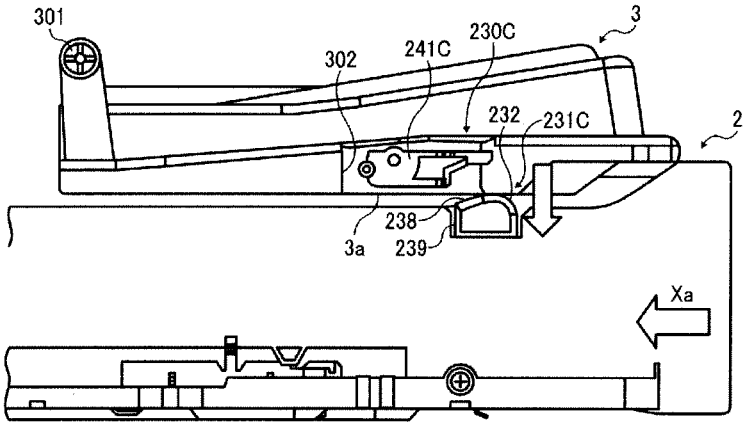
FIG. 19B is a vertical cross-sectional view illustrating operation of the stopper mechanism in a state in which the discharge tray is located at a closed position.
Figure 20A:
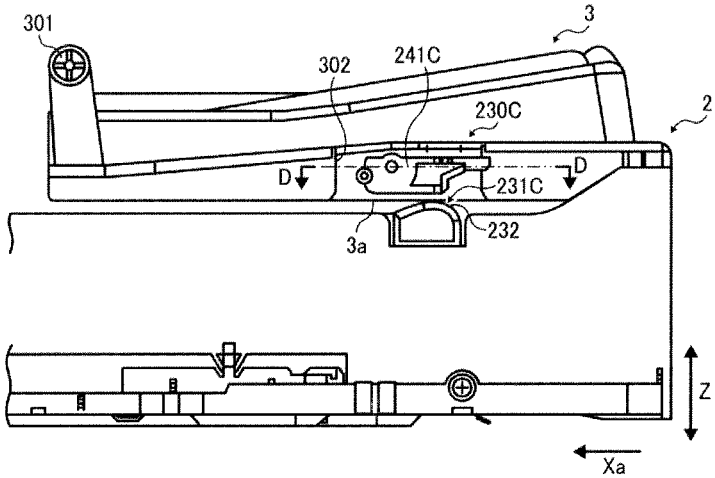
FIG. 20A is a vertical cross-sectional view illustrating the stopper mechanism in a state in which the sheet feed cassette is set in the image forming apparatus.
Figure 20B:
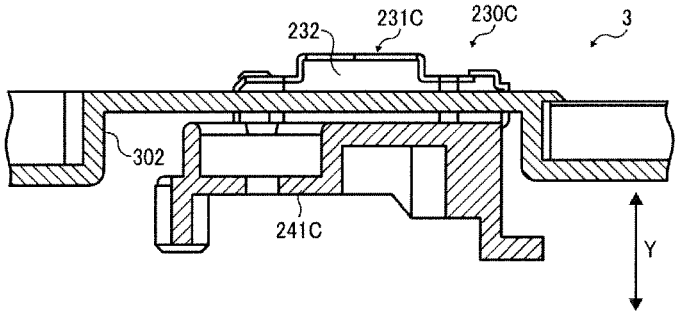
FIG. 20B is a horizontal cross-sectional view along a line D-D in FIG. 20A.

FIG. 18A is a perspective view illustrating an example of a configuration of the stopper mechanism 230C provided to the image forming apparatus 1 according to the second illustrative embodiment. FIG. 18B is an enlarged vertical cross-sectional view illustrating an example of a configuration of a stopped member 231C included in the stopper mechanism 230C. FIG. 19A is a vertical cross-sectional view illustrating operation of the stopper mechanism 230C in a state in which the discharge tray 3 swings open from the sheet feed cassette 2. FIG. 19B is a vertical cross-sectional view illustrating operation of the stopper mechanism 230C in a state in which the discharge tray 3 is located at the closed position. FIG. 20A is a vertical cross-sectional view illustrating the stopper mechanism 230C in a state in which the sheet feed cassette 2 is set in the image forming apparatus 1. FIG. 20B is a horizontal cross-sectional view along a line D-D in FIG. 20A.

Compared to the stopper mechanism 230A of the first illustrative embodiment, in place of the stopped member 231A and the stopper member 241A, the stopped member 231C and a stopper member 241C engageable with the stopped member 231C are included in the stopper mechanism 230C according to the second illustrative embodiment. The rest of the configuration according to the second illustrative embodiment is the same as the configuration according to the first illustrative embodiment.

The stopped member 231C of the stopper mechanism 230C is movably mounted to the sheet feed cassette 2 in the vertical direction Z, and is lifted from the sheet teed cassette 2 toward the discharge tray 3 when the discharge tray 3 swings open from the sheet feed cassette 2 as illustrated in FIG. 18A. The stopped member 231C includes the sloped portion 232 pressed by the bottom wall 3*a* of the discharge tray 3 disposed above a main body 231Ca of the stopped member 231C, the contact surface 239 contacted by the stopper member 241C when the stopped member 231C is lifted, the guide surface 238 provided adjacent to the contact surface 239 along the insertion direction Xa to move the stopped member 231C in the vertical direction Z by engagement with the stopper member 241C, and the hollow portion within which the spring 234 is disposed.

The guide surface 238 is sloped downward from upstream to downstream in the insertion direction Xa of the sheet feed cassette 2.

In the present illustrative embodiment, the sloped portion 232, the contact surface 239, the guide surface 238, and the hollow portion together form the stopped member 231C as a single integrated unit with resin. The stopped member 231C is supported via the spring 234 by the support member 237 fixed to the sheet feed cassette 2. The stopped member 231C is biased upward by the spring 234 provided within the hollow portion of the main body 231Ca, and engagement of the engagement portion 235 provided to the bottom end of the stopped member 231C and the engaged portion 236 fixed to the sheet feed cassette 2 restricts an amount of upward protrusion of the stopped member 231C. The stopper mechanism 230C is provided inside the sheet feed cassettes 2 on both sides of the sheet feed cassette 2 in the width direction Y.

Operation of the stopper mechanism 230C is described in detail below. As illustrated in FIG. 19A, the stopped member 231C provided to the sheet feed cassette 2 is lifted by the biasing force of the spring 234 when the discharge tray 3 swings open from the sheet feed cassette 2 so that the contact surface 239 contacts the stopper member 241C provided to the image forming apparatus 1 to prevent insertion of the sheet feed cassette 2 into the image forming apparatus 1 in the insertion direction Xa.

When the discharge tray 3 swings downward to the closed position as illustrated in FIG. 19B, the bottom surface 3*a* of the discharge tray 3 presses the sloped portion 232 of the stopped member 231C downward so that the stopped member 231C is lowered by the weight of the discharge tray 3 against the biasing force of the spring 234.

In a case in which the sheet feed cassette 2 is inserted into the image forming apparatus 1 in the insertion direction Xa during the downward movement of the stopped member 231C, the stopper member 241C first contacted by the contact surface 239 is then contacted by the guide surface 238 of the stopped member 231C as the sheet feed cassette 2 is inserted into the image forming apparatus 1.

At this time, the sloped guide surface 238 that contacts and engages the stopper member 241C divides the force to insert the sheet feed cassette 2 in the insertion direction Xa into a component of force that moves the stopped member 231C further downward against the biasing force of the spring 234 so that the sheet feed cassette 2 can be inserted into the image forming apparatus 1 without interference of the stopper member 241C.

In a case in which the sheet feed cassette 2 is inserted into the image forming apparatus 1 after the discharge tray 3 is located at the closed position, the bottom surface 3*a* of the discharge tray 3 presses the sloped portion 232 of the stopped member 231C downward to lower the stopped member 231C so that the stopped member 231C is not contacted by the stopper member 241C. As illustrated in FIG. 20B, the recessed portion 302 which prevents contact with the stopper member 241C is formed inwardly at the bottom of both external walls of the discharge tray 3 in the width direction Y, thereby contacting the bottom surface 3*a* of the discharge tray 3 against the stopped member 231C. Accordingly, the sheet feed cassette 2 can be smoothly inserted into the image forming apparatus 1 without interference of the stopper member 241C.

Upon completion of insertion of the sheet feed cassette 2 into the image forming apparatus 1, the bottom plate 41 is located at the sheet feed position so that the sheets 42 can be fed from the sheet feed cassette 2.

According to the second illustrative embodiment, the installation space of the stopper mechanism 230C in the width direction Y of the image forming apparatus 1 can be minimized, and thus making the image forming apparatus 1 more compact.

Although being disposed on both sides of the sheet feed cassette 2 in the width direction Y in the above-described example, alternatively, the stopper mechanism 230C may be disposed only on the single side of the sheet feed cassette 2 in the width direction Y. As a result, the number of components can be further reduced and the image forming apparatus 1 can be further downsized, thereby reducing production costs.

The foregoing illustrative embodiment is also applicable to image forming apparatuses employing the electrophotographic method such as printers, copiers, plotters, facsimile machines, and multifunction devices having two or more those capabilities as long as the sheet feed cassette 2 and the discharge tray 3 according to the foregoing illustrative embodiments can be installed.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus comprising:

a sheet container at least partially withdrawable from the image forming apparatus to a sheet supply position and including a platform member on which a sheet is placed, the platform member being hinged between a sheet feed position in which the sheet placed on the platform member contacts a sheet feed unit provided to the image forming apparatus and a lower position lowered from the sheet feed position, the platform member being located at the lower position upon withdrawal of the sheet container from the image forming apparatus by a predetermined distance;

a sheet stacking member on which a sheet discharged from the image forming apparatus is stacked, the sheet stacking member hinged to the image forming apparatus to closably open the sheet container;

a restriction unit to restrict a swinging movement of the sheet stacking member in a state in which the platform member is located at the sheet feed position and allow the swinging movement of the sheet stacking member in a state in which the platform member is located at the lower position; and a stopper mechanism to restrict insertion of the sheet container into the image forming apparatus in a state in which the sheet stacking member swings open from the sheet container, the stopper mechanism comprising:

a stopped member provided to the sheet container, the stopped member being movable vertically along the swinging movement of the sheet stacking member and being lifted from the sheet container toward the sheet stacking member in the state in which the sheet stacking member swings open from the sheet container; and a stopper member provided to the image forming apparatus, the stopper member being contactable with the stopped member at a portion inside the sheet container in a width direction perpendicular to a direction of withdrawal of the sheet container, the stopped member comprising:

a stopped surface contacted by the stopper member in a state in which the stopped member is lifted; and a switching surface adjacent to the stopped surface, the switching surface vertically moving the stopped member by contact against the stopper member.

2. The image forming apparatus according to claim 1, wherein the stopper mechanism is disposed on only one lateral side of the sheet container.

3. The image forming apparatus according to claim 1, further comprising a locking member provided to the stopper member to lock the sheet stacking member, the locking member being movable by contact against the stopped member.

4. The image forming apparatus according to claim 1, wherein the stopped member is formed of metal.

5. The image forming apparatus according to claim 1, further comprising an insertion mechanism to insert the sheet container into the image forming apparatus, wherein, upon insertion of the sheet container into the image forming apparatus, the restriction unit combines the sheet container with the sheet stacking member to insert the sheet container thus combined with the sheet stacking member into the image forming apparatus in a state in which an upstream portion of the sheet container is lifted.

6. The image forming apparatus according to claim 5, wherein:

the sheet container further comprises a bottom wall slidable against a base portion of the image forming apparatus; and the insertion mechanism comprises:

a sloped guide portion provided to the base portion, the sloped guide portion sloping upward along the direction of insertion of the sheet container into the image forming apparatus; and a first protrusion provided to the bottom wall, the first protrusion protruding downward to contact the sloped guide portion.

7. The image forming apparatus according to claim 6, further comprising:

a recessed portion provided to the base portion to position the sheet container; and a second protrusion provided to the bottom wall to contact the recessed portion.

* * * * *